US012193528B2

(12) United States Patent
Nylund

(10) Patent No.: US 12,193,528 B2
(45) **Date of Patent: *Jan. 14, 2025**

(54) PROTECTIVE STRUCTURE FOR PROTECTIVE GARMENTS AND EQUIPMENT

(71) Applicant: Tackla Licensing Corporation Oy, Savitaipale (FI)

(72) Inventor: Mauri Nylund, Savitaipale (FI)

(73) Assignee: TACKLA LICENSING CORPORATION OY, Savitaipale (FI)

( * ) Notice: Subject to any disclaimer, the term of this patent is extended or adjusted under 35 U.S.C. 154(b) by 376 days.

This patent is subject to a terminal disclaimer.

(21) Appl. No.: 17/427,336

(22) PCT Filed: Jan. 27, 2020

(86) PCT No.: PCT/FI2020/000002

§ 371 (c)(1),
(2) Date: Jul. 30, 2021

(87) PCT Pub. No.: WO2020/157372

PCT Pub. Date: Aug. 6, 2020

(65) Prior Publication Data

US 2022/0095712 A1 Mar. 31, 2022

(30) Foreign Application Priority Data

Feb. 1, 2019 (FI) ..... 20197015

(51) Int. Cl.

| | |
|---|---|
| ***A41D 13/015*** | (2006.01) |
| ***A41D 13/05*** | (2006.01) |
| ***A63B 71/12*** | (2006.01) |

(52) U.S. Cl.
CPC ..... *A41D 13/0158* (2013.01); *A41D 13/05* (2013.01); *A63B 71/1225* (2013.01); *A63B 2071/1208* (2013.01)

(58) Field of Classification Search
CPC . A63B 71/1225; A63B 71/1208; A63B 71/08; A63B 71/12
See application file for complete search history.

(56) References Cited

U.S. PATENT DOCUMENTS 5,361,410 A * 11/1994 Sigl ..... A63B 71/08 2/904
5,557,804 A * 9/1996 Ovortrup ..... A41D 13/0506 2/467

(Continued)

FOREIGN PATENT DOCUMENTS

EP 3075274 A1 10/2016
WO WO2013/181316 A2 12/2013

*Primary Examiner* — Jocelyn Bravo
(74) *Attorney, Agent, or Firm* — BelayIP

(57) ABSTRACT

A protective structure for protective garments and equipment is disclosed having a flat curved plate like object which includes a mesh structure having a multitude of holes. The holes in the mesh structure or parts of the holes in the mesh structure have rim structures extending towards a user of the protective structure when the protective structure is in use. Between the rim structures are channels. The channels improve air circulation beneath the protective structure and the rim structures enhances the impact spreading and elasticity of the protective structure. A continuous border frame surrounds the mesh structure. The protective structure has a first surface and a second surface, and the second surface is oriented towards the user when the protective structure is in use.

14 Claims, 5 Drawing Sheets

(56) References Cited

U.S. PATENT DOCUMENTS

| | | | | |
|---|---|---|---|---|
| 5,680,657 | A * | 10/1997 | Valtakari | A41D 13/0158 2/455 |
| 9,956,471 | B2 * | 5/2018 | Nylund | A41D 13/015 |
| 10,159,295 | B2 * | 12/2018 | Frey | A42B 3/065 |
| 2003/0088900 | A1 * | 5/2003 | Cho | A63B 71/1225 2/22 |
| 2005/0050619 | A1 * | 3/2005 | Dunn | B32B 3/30 2/458 |
| 2006/0179538 | A1 * | 8/2006 | Dodd | A41D 13/0543 2/22 |
| 2007/0186328 | A1 * | 8/2007 | Bulian | A41D 1/084 2/69 |
| 2009/0276933 | A1 * | 11/2009 | Dodd | A43B 17/00 2/22 |
| 2011/0126337 | A1 * | 6/2011 | Aris | A41D 1/067 112/475.09 |
| 2012/0129418 | A1 * | 5/2012 | Ingle | D06M 11/83 2/463 |
| 2012/0164377 | A1 * | 6/2012 | Lin | B32B 27/08 428/137 |
| 2013/0232674 | A1 * | 9/2013 | Behrend | A41D 13/0002 2/455 |
| 2014/0245527 | A1 | 9/2014 | Douglas et al. | |
| 2015/0328527 | A1 * | 11/2015 | Nylund | A63B 71/12 2/455 |
| 2017/0144053 | A1 * | 5/2017 | Ferrari | A41D 13/0158 |
| 2018/0153237 | A1 * | 6/2018 | Karall | A41D 31/28 |
| 2018/0169505 | A1 * | 6/2018 | Piombino | A41D 13/0581 |
| 2022/0095712 | A1 * | 3/2022 | Nylund | A41D 13/05 |
| 2022/0361609 | A1 * | 11/2022 | Nylund | A41D 13/05 |

* cited by examiner

PROTECTIVE STRUCTURE FOR PROTECTIVE GARMENTS AND EQUIPMENT

CROSS REFERENCE TO RELATED APPLICATIONS

This application is a national phase application of International Application No.: PCT/FI2020/000002, filed Jan. 27, 2020, and further claims priority to Finnish Patent Application 20197015, filed Feb. 1, 2019, the contents of both of which are incorporated herein by reference.

BACKGROUND OF THE INVENTION

The present disclosure relates to a protective structure for protective garments and equipment, comprising a first surface, a second surface, a curved mesh structure having a multitude of holes extending from the first surface to the second surface, and a border frame surrounding the mesh structure at least partly, and the protective structure is configured to be positioned in a garments in a such way that the second surface is towards the user of the garment, and the material of the protective structure is rigid.

Many sporting and safety garments and equipment feature protective structures. Protective structures are present, for example, in ice hockey leg shields, breast and shoulder shields and in pants and safety garments that protect users from falls and high impacts. The protective structures are fairly stiff structures that are usually made of a plastic material, the purpose of the protective structures being receiving shocks and distributing the energy of the shock over a wider area.

Protective structures for protective garments and equipment have traditionally been made from sheet-like material by die-cutting and forming the die-cut piece by to a desired shape by subjecting it to heat. Also, the sheet-like material is bent during die-cutting in order to improve the stiffness of the piece. Also, openings have been made in the piece during die-cutting in order to lighten the piece. Plastic has normally been the material of choice. Such protective structures have been used in the outer surface of sporting equipment, for example with ice hockey leg shields or inside the sporting equipment, wedged between softer protective structures such as foamed plastics. The purpose of the protective structure is to receive shocks and impacts from the outside and to distribute their energy over a wider area. The protective structure and its material should be substantially rigid for maintaining the shape of the protective structure. However, the protective structure should bend when receiving impacts for distributing energy over a wider area.

A protective structure made of sheet-like material by die-cutting becomes fairly heavy. The thickness of the material is the same throughout the whole piece and the ability of the piece to distribute shocks effectively over a wider area remains rather limited. The described protective structure also traps heat and prevents air from circulating under the protective structure, causing discomfort and fatigue.

The following publications address some of these problems.

Patent publication FI103862 shows a protective pad for a garment equipped with separate protective pads that are inserted into pockets. Each protective pad is composed of a flexible cellular protective pad material, which retains its shape and comprises interconnected walls which extend from an outer surface to an inner surface of the protective pad, the walls having a width in the direction of the surface of the pad which is smaller than the height of the wall in the thickness direction of the protective pad. The walls form cells with a closed periphery such that between the walls of the cells there remain holes extending through the pad. The pad is made from a sheet-like cellular material by cutting the material into a shape having the appropriate contour. The width of the walls increases from the outer surface towards the inner surface of the pad. The pad can be manufactured, for example, by injection moulding or by producing a cellular sheet, where cells needed for the pad are on a big sheet. The heights of the walls, namely the thickness of the pad, are the same on the whole area of the pad.

Patent publication FI124192 shows a protective structure comprising, at least in one direction, a curved support rib structure of a material that is suited for injection moulding. The thickness of the support rib structure varies in a direction perpendicular to a surface formed by the support rib structure so that the thickness is greater at the middle of the support rib structure as compared to the material thickness at the edges of the support rib structure. This kind of structure improves impact energy distribution and makes the whole structure lighter.

However, there is a clear need for improving protective structures for protective garments and equipment. It would be especially beneficial if the weight could be reduced and air circulation in the protective structure could be improved. If these goals can be achieved, there can also be other uses for the protective structures, in addition to sporting equipment.

BRIEF SUMMARY OF THE INVENTION

An object of the present disclosure is a solution that can significantly reduce the disadvantages and drawbacks of the prior art. In particular, an object of the present disclosure is a solution where a light protective structure with improved air circulation properties is provided.

The present disclosure is a protective structure for protective garments and equipment. The protective structure is a flat curved plate like object that comprises a mesh structure having a multitude of holes. The holes in the mesh structure or the parts of the holes in the mesh structure have rim structures extending towards the user when the protective structure is in use and between the rim structures are channels. The channels improve air circulation beneath the protective structure and the rim structures and enhances impact-spreading and the elasticity of the protective structure. A continuous border frame surrounds the mesh structure. The protective structure has a first surface and a second surface, and the second surface is oriented towards the user of the protective structure when the protective structure is in use.

If it is mentioned that some part of the protective structure is higher than some other part of the protective structure, then a situation where the protective structure is laying on a surface with the first surface down is described. Also, when some direction or surface or part is referred to by 'outer', it is meant that it is away from the user when the protective structure is in use.

In one embodiment of the present disclosure, a protective structure for protective garments and equipment is provided, the one embodiment comprising a first surface, a second surface, a curved mesh structure having a multitude of holes extending from the first surface to the second surface, and a border frame surrounding the mesh structure at least partly, and the protective structure is configured to be positioned in garments or equipment in a such way that the second surface is oriented towards the user of the garments or equipment, and the material of the protective structure is rigid. The term rigid means here that the protective structure maintains its form in a normal use. Impacts may bend the protective structure. In one advantageous embodiment of the invention, the edges of the holes in the mesh structure have rim structures extending towards the second surface from the mesh structure and the rim structure has a top side, an inner side and an outer side, and between the rim structures are channels formed by the sides of the rim structures and the mesh structure, and the top sides of the rim structures form at least part of the second surface, and the heights of the rim structures are greater at the middle of the mesh structure as compared to the heights of the rim structures at the edge of the mesh structure.

In one embodiment of the protective structure, the rim structures are separate from each other. This feature allows the channels to be continuous and the elasticity of the protective structure is enhanced and its impact-distribution properties are improved.

In a second embodiment of the protective structure, the rim structures are continuous at holes which do not touch the border frame. This means that the rim structures surround the holes that are not delimited by the edge of the mesh structure. This feature guides the air circulation and improves the impact durability of the protective structure.

In a third embodiment of the protective structure, the thickness of the border frame is less than the distance between the first surface and the second surface at the edge of the mesh structure. This feature provides an arrangement that can be used for fixing the protective structure to garments or fixing some material to the protective structure. Also, this diminishes the weight of the protective structure.

In a fourth embodiment of the protective structure, at least one of the curvature radiuses of the second surface is greater than the corresponding curvature radius of the first surface.

In a fifth embodiment of the protective structure, the holes are circular or elliptical or at least partly circular or elliptical. The holes are partly circular or elliptical where the border frame limits them. Circular shapes are found to be durable, and they spread the impact forces efficiently.

In a sixth embodiment of the protective structure, the centre points of three adjacent holes form an equilateral triangle of a triangle, the sides of which differ from each other in length by 20% at most. This kind of placement of the holes yields a durable and light mesh structure.

In a seventh embodiment of the protective structure, there is a ventilation hole opening between three adjacent holes to the channels between the rim structures. This hole ventilates the channel between the rim structures. Also, it has been found that they further lessen the stress forces. Furthermore, they reduce the total mass of the protective structure.

In an eight embodiment of the protective structure, the border frame is configured in such a way that at least a cushioning and a supporting fabric layer can be fixed to the border frame. In a ninth embodiment of the protective structure, the cushioning and the supporting fabric layer are configured to be fixed to the border frame in such a way that the middle parts of the cushioning and the supporting fabric layer are separate from the second surface.

In a tenth embodiment of the protective structure, at least some of the holes have a collar structure on the inner side of the rim structure, and the upper side of the collar structure is on the same level as the first surface.

In an eleventh embodiment of the protective structure, at least some of the holes have a collar structure on the inner side of the rim structure, and the upper side of the collar structure is on the same level as the second surface.

In a twelfth embodiment of the protective structure, the mesh structure and the border frame are of a material or material composition that is suited for injection moulding.

In a thirteenth embodiment of the protective structure, the mesh structure and the border frame are coated with a material containing metallic particles.

In a fourteenth embodiment of the protective structure, the metallic part is made of metallic material having a microstructure which is fine-grained with an average grain size between 2 and 5,000 nm. This feature improves the impact resistance of the protective structure.

In a fifteenth embodiment of the protective structure, the open surface area of the mesh structure, for example a total area of the holes, is at least 60% of the total area of the mesh structure in its entirety. This makes the protective structure light and at the same time durable.

In a sixteenth embodiment of the protective structure, the diameters of the holes are between 2 and 7 cm. Bigger holes do not provide any more protection from direct hits and using smaller holes increases the mass of the protective structure and impairs air circulation.

It is an advantage of the present disclosure that it provides a protective structure that is light and has efficient air circulation.

Using the protective structure significantly improves impact-spreading and thus diminishes the probability of injuries. It also makes for a product that has no complex parts, so that it is easier to manufacture and maintain than devices according to known techniques.

One advantage of the present disclosure is that it is quite durable and retains its form but is still elastic when receiving impacts. The protective structure can also be easily and quickly integrated in different kinds of garments and equipment.

It is a further advantage of the present disclosure that additional devices, such as sensors, can be easily integrated in the protective structure. Also, the present disclosure makes it possible, due its lightness and efficient air circulation, to use the protective structure for example in safety garments for elderly people.

BRIEF DESCRIPTION OF THE SEVERAL VIEWS OF THE DRAWINGS

Further advantages features and details of the various embodiments of this disclosure will become apparatus from the ensuing description of a preferred exemplary embodiment or embodiments and further with the aid of the drawings. The features and combinations of features recited below in the description, as well as the features and feature combination shown after that in the drawing description or in the drawings alone, may be used not only in the particular combination recited but also in other combinations on their own without departing from the scope of the disclosure.

In the following, the invention is described in detail. The description refers to the accompanying drawings, in which.

DETAILED DESCRIPTION OF THE INVENTION

As used throughout the present disclosure, unless specifically stated otherwise, the term "or" encompasses all possible combinations, except where infeasible. For example, the expression "A or B" shall mean A alone, B alone, or A and B together. If it is stated that a component includes "A, B, or C", then, unless specifically stated otherwise or infeasible, the component may include A, or B, or C, or A and B, or A and C, or B and C, or A and B and C. Expressions such as "at least one of" do not necessarily modify an entirety of the following list and do not necessarily modify each member of the list, such that "at least one of "A, B, and C" should be understood as including only one of A, only one of B, only one of C, or any combination of A, B, and C.

The embodiments in the following description are given as examples only and someone skilled in the art can carry out the basic idea of the invention also in some other way than what is described in the description. Though the description may refer to a certain embodiment or embodiments in several places, this does not mean that the reference would be directed towards only one described embodiment or that the described characteristic would be usable only in one described embodiment. The individual characteristics of two or more embodiments may be combined and new embodiments of the invention may thus be provided.

Figure 1:
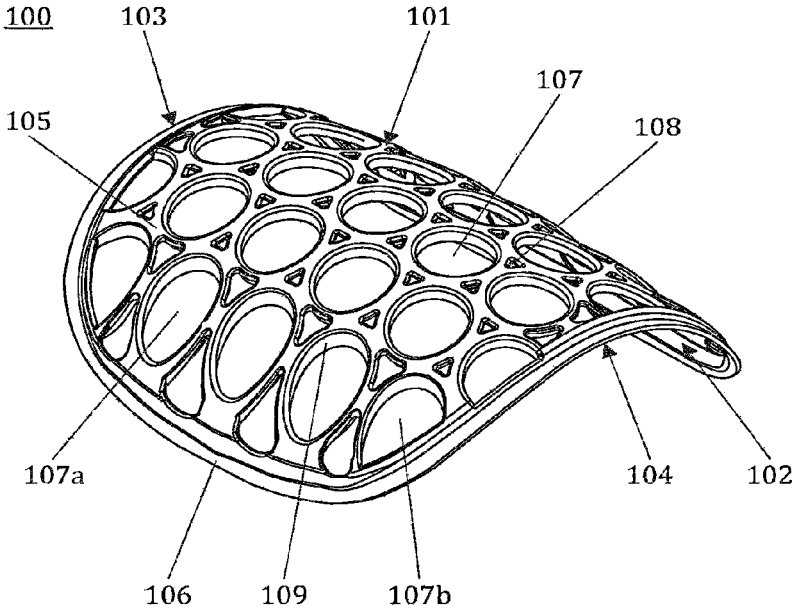
FIG. 1 depicts an example of a protective structure according to an embodiment.

FIG. 1 depicts an embodiment of a protective structure 100. The protective structure is of a plate-like construct having a first surface 101 and a second surface 102 and a first end 103 and a second end 104. The protective structure is configured in such a way that when the protective structure is in use, for example it is installed in a garment or equipment and the user is wearing it, the second surface is towards the user. The protective structure is curved in a such way that the body part to be protected is partly surrounded by the protective structure. The curvature of the protective structure in the embodiment in FIG. 1 affects only one direction, but the curvature can affect many different directions. The protective structure could for example take the form of a hemisphere, a half ellipse or any combination of these. Choosing the correct curvature depends on where the protective structure is to be placed and how the impact forces are to be distributed. The material of the protective structure is rigid, which means that it retains its form during normal use. The shaping of the protective structure provides some elasticity for distributing impact forces.

The protective structure 100 comprises a mesh structure 105 and a border frame 106. The mesh structure has a multitude of holes 107 extending from the first surface 101 to the second surface 102. Between the holes are rib structures which function as a frame for the mesh structure. The border frame surrounds the mesh structure at least partly. In this embodiment the border frame is a flat shelf. The border frame serves to support the mesh structure and in some embodiments, it also serves as a platform for fixing the protective structure to a garment or equipment. Also, in some embodiments the border frame can be used for attaching cushioning to the second surface. Some supporting fabric layers can be fixed to the border frame, too. The holes on the mesh structure have some kind of geometrical shape. In this embodiment, holes are circular or elliptical or partly circular or elliptical. Of course, in some embodiments t hey can be rectangular or take some other form. It must be noted that shapes of the holes can vary in different parts of the mesh structure. The border frame delimits the mesh structure in such a way that some of the holes 107*a* are whole and some holes 107*b* are incomplete, namely, they are truncated. In some embodiments the thickness of the border frame is less than the distance between the first surface and the second surface at the edge of the mesh structure.

The edges of the holes 107 on the mesh structure 105 have rim structures 109 extending towards the second surface 102 from the mesh structure, namely, the rim structures are oriented towards the user when the protective structure 100 is in use. The rim structure is a wall-like construct and has a top side, an inner side and an outer side. Between the rim structures are channels which can be used, for example, for guiding air currents in the horizontal direction in relation to the protective structure, namely, inside the protective structure. The channels are formed by the sides of the rim structures and the mesh structure, and, more particularly, the outer sides of the rim structures and the lower surfaces of the rib structures (namely a surface of the rib structure that is towards the second surface). The channels are open to the second surface 102. The height of the rim structure is the distance from the first surface 101 to the top side of the rim structure, namely, the height is measured in the hole. The inner side is towards the hole that the rim structure is surrounding. The top sides of the rim structures form at least part of the second surface, namely, the thickness of the mesh structure is the vertical distance from the first surface to the top side of the rim structure. The heights of the rim structures are greater at the middle of the mesh structure compared to the heights of the rim structures at the edge of the mesh structure. This means that the thickness of the mesh structure is greater at the middle of the mesh structure compared to the thickness of the mesh structure at the edge of the mesh structure. The first surface and the second surface have curvature radiuses. In some embodiments one of the curvature radiuses of the second surface is greater than the corresponding curvature radiuses of the first surface. The term 'corresponding' means here that they are on top of each other and have the same direction.

In some embodiments the rim structures 109 are separate from each other. The mesh structure frame (rib structure) between the holes 107 can be interpreted as a beam having a U-shaped groove. The walls of the groove are rim structures of the two adjacent holes and the bottom of the groove is the rib structure between the two same adjacent holes. These grooves form the channel network in the protective structure. Preferably the protective structure is configured in such a way that there is free space inside the channels when the protective structure is in use.

The rim structures 109 are continuous at holes 107*a* that do not touch the border frame 106, namely, the rim structure completely surrounds the hole. The holes that are delimited by the border frame may have rim structures that end at the point where the edge of the hole meets the border frame.

When the protective structure 100 is manufactured by injection moulding, the usage of raw material can be minimized compared to a protective structure manufactured by die-cutting. There is always a rather big wastage when pieces of a desired size and form are die-cut from a uniform sheet with die-cut techniques. Injection moulding makes it is also possible to optimize the thickness of the mesh structure 105 so that sufficient stiffness and strength are achieved with a minimum of material. Injection moulding makes elaborate designs possible and thus shape whole protective structure in the desired way. The mesh structure can thus be as aesthetically pleasing as desired. Suitable materials for injection moulding are all plastic materials as well as plastic materials that are reinforced, for example carbon fibre. The material must naturally be of such a variety that it achieves sufficient hardness after curing. The protective structure can be manufactured from such a plastic grade or such a composite of a plastic and a reinforcing material that are best suited for each application. For enhancing the hardness of the protective structure, the mesh structure and the border frame can be coated with a material containing metallic particles. This prevents cracks and fracture formation. Thus, lighter and softer materials can be used. The best results are achieved when the metallic particles are metallic material having a microstructure which is fine-grained with an average grain size between 2 and 5,000 nm. The coating improves the properties of the protective structure, allowing it to be made lighter.

It must be noted that the protective structure 100 can be non-symmetrical. For example, the width of the protective structure can be greater near the first end 103 than near the second end 104.

In the embodiment described in the FIG. 1 the holes 107 are positioned on the mesh structure 105 in such a way that they are interleaved to cover as much an area as possible and still keep the frame of the mesh structure solid, namely, the rib structures between holes should not become too narrow. In some embodiments the centre points of three adjacent holes form an equilateral triangle, the sides of which differ from each other in length by 20% at most. The length of the sides may vary because of the shapes of the holes and the geometry (curvature) of the mesh structure.

In some embodiments there is a ventilation hole 108 between three adjacent hole openings to the channels between the rim structures 109. There can be other embodiments in which the ventilation holes are positioned differently in case the holes are placed in some other formation. For example, the centres of the holes may form an equidistant grid and the ventilation holes may be at the middle points of the squares formed by four adjacent holes. There can be ventilation holes in other places as well. For example, in the embodiment of the FIG. 1 there are also some ventilation holes near the border frame 106. The ventilation holes are for lightening the whole protective structure 100 and for guiding air currents in the channels.

The mesh structure 105 forms a cell-like structure having a large open surface. The large open surface contributes to making the protective structure 100 lightweight. In some embodiments the rib structures can be dimensioned so that the width of the rib structures in the direction of the surface of the support structure is smaller than the height of the rim structure 109. By varying the height of the rim structures, it is possible to regulate the stiffness and rigidity of the protective structure in the direction perpendicular to the surface of the protective structure. On the other hand, the rib structure can be kept narrow in the direction of the surface of the protective structure in order to achieve a large open area. Also, a large open area makes the air permeability of the protective structure especially high. In some embodiments the open surface area of the mesh structure is at least 60% of the total area of the mesh structure. The open area comprises both the holes 107 and the ventilation holes 108. Of course, the open area may be even larger, but this is the smallest limit, and below that the protective structure 100 becomes heavy and sweaty in use.

The protective structure 100 can thus on the other hand be made light, but still stiff and rigid enough. The stiffness of the protective structure can be regulated also by changing the size of the mesh structure 105.

The amount of material used in the mesh structure 105 can be optimized in relation to the stiffness by varying the thickness of the mesh structure in a direction perpendicular to the first surface 101 formed by the mesh structure so that the material thickness is greater at the middle of the mesh structure compared to the thickness at the edges of the mesh structure. More material can be concentrated in those parts of the mesh structure where the benefit in relation to the stiffness is the greatest. By concentrating more material in the middle of the mesh structure the middle part of the mesh structure will become stiffer and the edges more flexible. In consequence, the middle part of the mesh structure can withstand impacts and transfer impact energy to the edges of the protective structure 100 more efficiently. The more flexible edge parts of the protective structure also contribute to the suitability of the protective structure in some equipment, and improving user comfort. The rim structures 109 can be applied for improving the aforementioned.

In some embodiments the diameters of the holes 107*a* positioned wholly in the mesh structure are between 2 and 7 cm, namely, they constitute the holes that are not delimited by the border frame 106. If the diameters are larger, namely, the holes are bigger, the projectiles may penetrate the protective structure 100. These impacts may be, for example, strikes by hockey pucks.

Figure 2:
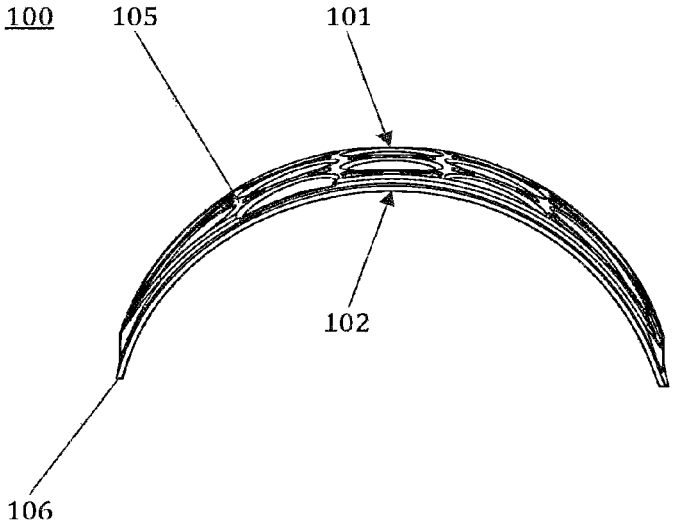
FIG. 2 depicts the protective structure presented in FIG. 1 as seen from one end.

FIG. 2 depicts the protective structure 100 presented in FIG. 1 as seen from the direction of the second end 104. The protective structure has a longitudinal axis on the first surface from the middle point of the second end to the middle point of the first end. The protective structure is curved in such a way that if the longitudinal axis is considered as the top of the protective structure, the edges of the protective structure parallel to the longitudinal axis are lower than the longitudinal axis. The thickness of the border frame 106 is less than the distance between the first surface and the second surface at the edge of the mesh structure. In some embodiments there may be a step at the edge of the mesh structure 105.

Figure 3:
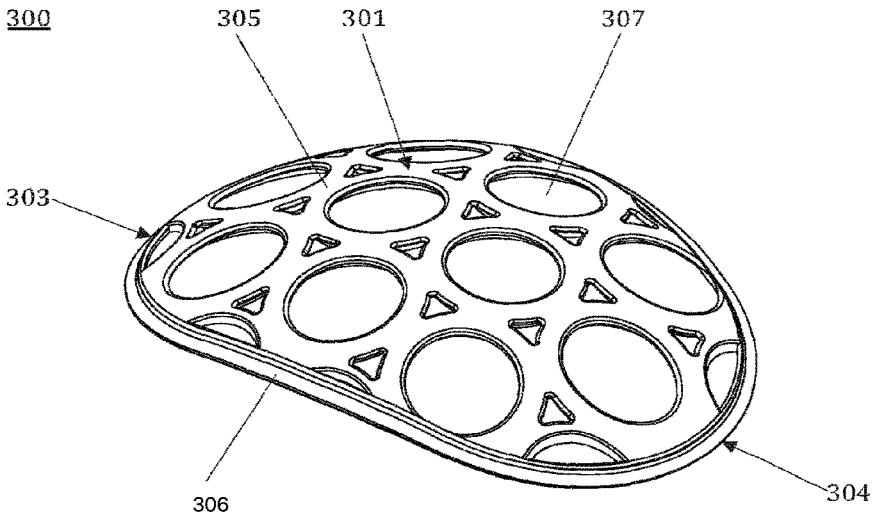
FIG. 3 depicts a second example of a protective structure according to an embodiment.

FIG. 3 depicts a second embodiment of a protective structure 300 having a first surface 301 and a second surface and the first end 303 and the second end 304. The protective structure comprises a mesh structure 305 and a border frame 306. The mesh structure has a multitude of holes 307 extending from the first surface 301 to the second surface. Between the holes are rib structures which function as a frame of the mesh structure. On the mesh structure between adjacent holes 307 are ventilation holes 308.

Figure 4:
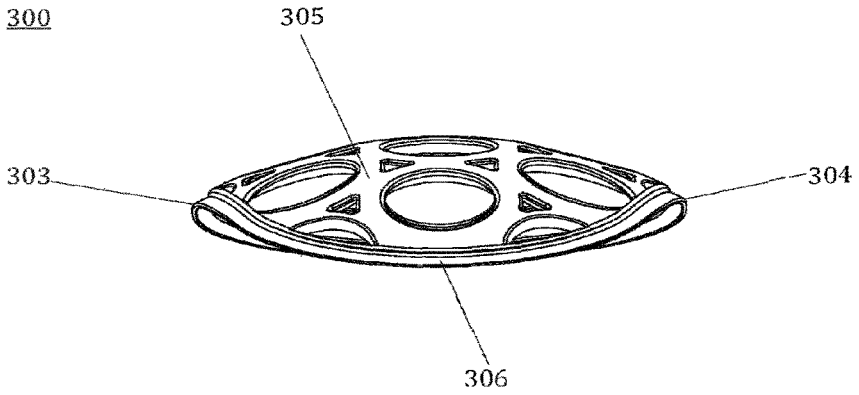
FIG. 4 depicts the protective structure presented in FIG. 1 as seen from below.

FIG. 4 depicts the protective structure 300 presented in FIG. 3 as seen from the side. The outermost point of the mesh structure 305 sets a top level that is parallel to the longitudinal axis between the first end and the second end. The border frame 306 curves upwards (i.e. towards the top level of the protective structure) at the first end 303 and at the second end 304. This kind of design ensures an ideal anatomical fit for the protective structure.

Figure 5:
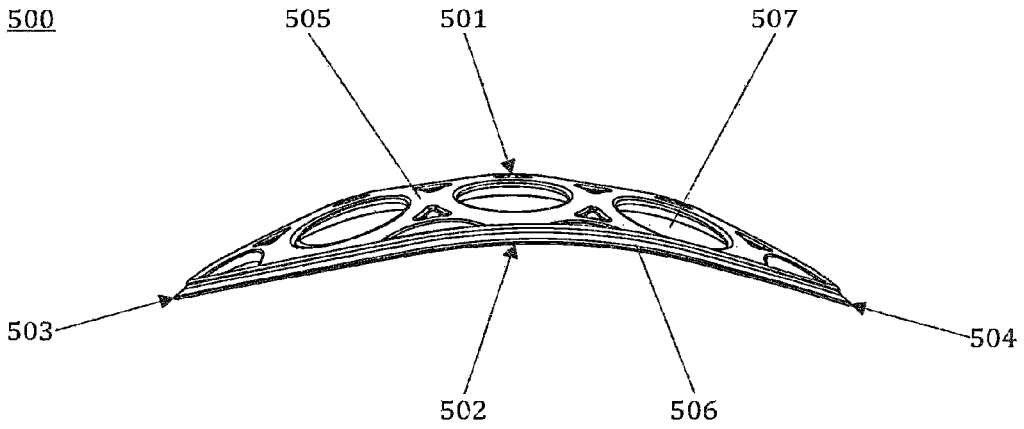
FIG. 5 depicts a third example of a protective structure according to an embodiment.

FIG. 5 depicts a third embodiment of a protective structure 500 having a first surface 501 and a second surface 502 and the first end 503 and the second end 504. The protective structure comprises a mesh structure 505 and a border frame 506. The mesh structure has a multitude of holes 507 extending from the first surface 501 to the second surface. Between the holes are rib structures that form the frame of the mesh structure, and one surface of the rib structures forms the outer surface of the protective structure, i.e. the first surface 501. The other surface of the rib structures is towards the second surface. The protective structure is slightly curved. The middle point, namely the top point of the mesh structure is located higher than the border frame (namely the top point is vertically farthest from the border frame plane). Even the slightly outward (namely the direction away from the user of the protective structure when the protective structure is in use) curvature of the mesh structure is beneficial, because a curved structure spreads impact forces more efficiently than a flat surface.

Figure 6:
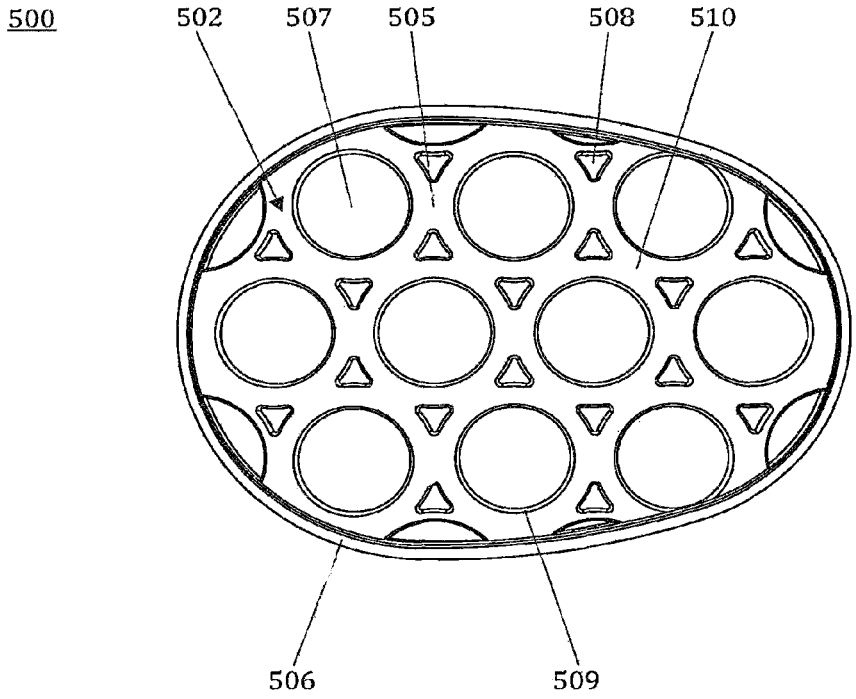
FIG. 6 depicts the protective structure presented in FIG. 5 as seen from below.

FIG. 6 depicts the protective structure 500 presented in FIG. 5 as seen from below, namely from the direction of the second surface 502. The holes 507 are surrounded by rim structures 509. The rim structures are wall-like structures, and they extend towards the second surface. The rim structures have inner sides that are towards the centre of the hole, the outer sides and the top sides. The top sides of the rim structures form at least part of the second surface 502. It must be noted that the second surface is partly virtual, namely there is no continuous material surface that would form the second surface.

Between the rim structures 509 are channels 510. The channels forms passages that are delimited by the rim structures (the outer sides of the rim structures), the surfaces of the rib structures which are towards the second surface and the second surface 502 (i.e., the plane between the top sides of the adjacent rim structures). At the edges of the mesh structure 505, the border frame 506 delimits the channel network. In some embodiments there may be some openings or grooves in the border frame that connect outer areas to the channels when the protective structure 500 is in use. There are ventilation holes 508 on the rib structures connecting the channel to the first surface 501. In this example the ventilation holes are situated between three adjacent holes 507 the centre points of which form a triangle. The ventilation holes serve to enhance air circulation. Also, they further decrease the total weight of the protective structure 500. Furthermore, careful positioning and shaping the ventilation holes allows for guiding and spreading the stress and impact forces of a strike on the protective structure. Also, the ventilation holes improve elasticity of the protective structure and prevent shearing forces on the rib structures.

Figure 7:
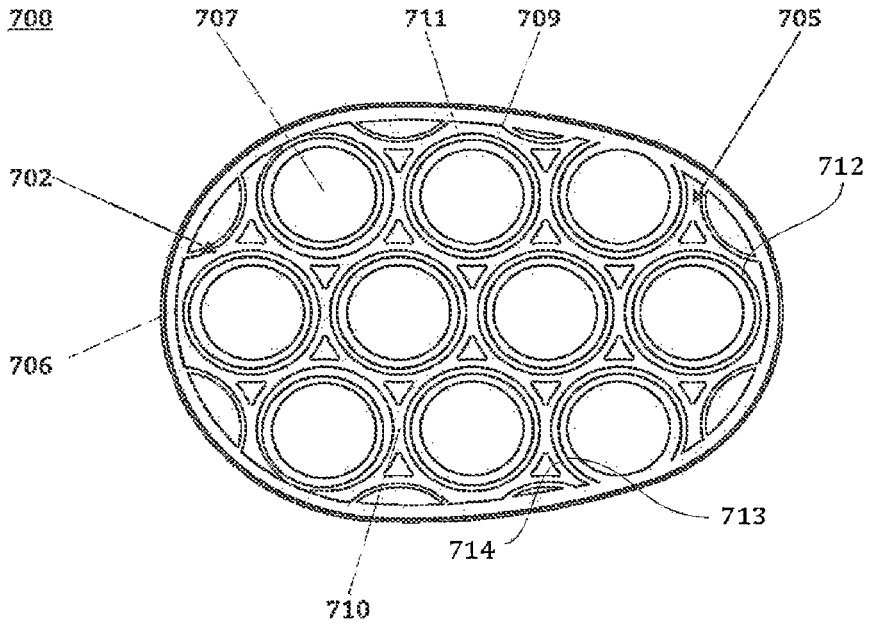
FIG. 7 depicts a fourth example of a protective structure according to an embodiment as seen from below.

FIG. 7 depicts a fourth embodiment of a protective structure 700 as seen from below, namely from the direction of the second surface 702. The protective structure comprises a mesh structure 705 and a border frame 706. In the mesh structure are a multitude of holes 707. There are rim structures 709 which circle the holes in the mesh structure and channels 710 between the rim structures. The rim structure comprises an inner side 713, an outer side 714, and a top side 712. In this embodiment there is a collar structure 711 on the inner wall of the rim structure. The collar structure has a first collar surface and a second collar surface that are approximately parallel to the first surface and to the second surface near the collar structure. In addition, the collar structure has a side surface that is parallel to the inner side of the rim structure. The side surface defines the height of the collar structure. The height of the collar structure is less than the height of the rim structure, namely the distance between the first surface and the top side of the rim structure (the second surface). In some cases, the collar structures may serve to increase the stiffness of the outer surface of the mesh structure (namely the first surface). Also, if some form of cushioning is used under the protective structure, namely between the second surface and the user, the collar structures can serve to prevent the cushioning from bulging out of the hole. In some embodiments the collar structure is positioned in such a way that the first collar surface forms a part of the first surface, namely the outer side of the mesh structure 705. This means that the diameter of the hole 707 on the first surface is less than the diameter of the hole on the second surface. In that case the collar structures do not form any steps on the first surface. Naturally, there are embodiments where the collar structures are positioned differently.

Figure 8:
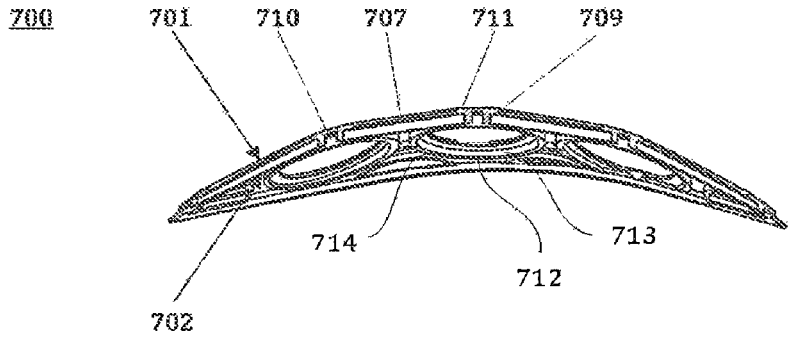
FIG. 8 depicts the protective structure presented in FIG. 7 as seen from the side.

FIG. 8 depicts the protective structure 700 presented in FIG. 7 as seen from the side as a cross section. The rim structure 709 circles the hole 707 extending downwards, namely towards the second surface 702. The collar structure 711 circles the hole and extends towards the middle point of the hole. Between the rim structures are channels 710 which form a channel network. The first collar surfaces are parallel and in the same level as the first surface 701 near the first collar surface. This means that the first surface is continuous, namely there are no sharp angles, and the curvature of the first surface is smooth. It must be noted that the first surface is partly virtual at the holes. In some embodiments the collar structure (the second collar surface) is in the same level as the second surface.

Figure 9:
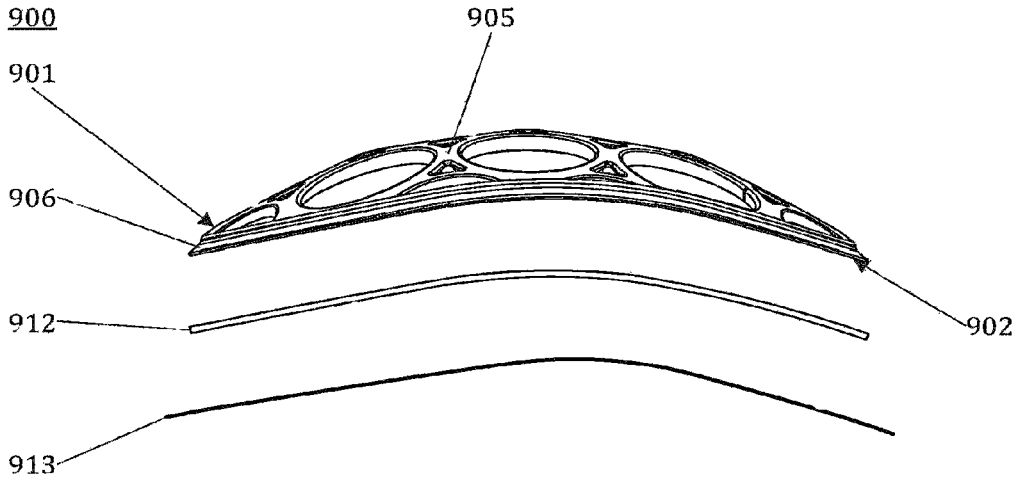
FIG. 9 depicts a fifth example of a protective structure according to an embodiment as seen from below.

FIG. 9 depicts a fifth embodiment of a protective structure 900. The protective structure has a first surface 901 and a second surface 902. The protective structure comprises a mesh structure 905 and a border frame 906. The protective structure further comprises a cushioning layer 912 and a supporting fabric layer. The border frame is configured in such a way that the cushioning and the supporting fabric layer can be fixed to the border frame. The fixing can be, for example, done by knitting, stapling, gluing or similar means. In some embodiments the supporting fabric layer is used to stretch the protective structure. In that case the mesh structure is tensioned and the protective structure, in addition to spreading the impact, also recoils from the impacts.

The mesh structure 905 effectively transfers the energy of an impact to the mesh structure from the firm crossing points of the mesh structure parts into every direction of the protective structure. The mesh structure can also be designed so that some projectile hitting the mesh structure transfers impact energy through the mesh structure into a cushioning layer 912 underneath the mesh structure. The cushioning could be for example a plastic foam structure or some such. The mesh structure and especially the rim structures will thus penetrate a certain distance into the cushioning whereas the energy of the impact is absorbed into the cushioning.

Some advantageous embodiments of the device according to the invention have been described above. The invention is however not limited to the embodiments described above, but the inventive idea can be applied in numerous ways within the scope of the claims.

The invention claimed is:

1. A protective structure for protective garments and equipment, the protective structure comprising:
- a first surface,
- a second surface,
- a curved mesh structure having a multitude of holes extending from the first surface to the second surface, and
- a border frame surrounding at least a part of the mesh structure, wherein the protective structure is configured to be positioned in a garment or equipment such that the second surface is facing towards a user of the garment or equipment, and wherein a material of the protective structure is rigid, wherein each hole of the multitude of holes on the mesh structure are is surrounded at least partly by a respective wall-like rim structure extending towards the second surface from the mesh structure, each rim structure has a top side, an inner side, and an outer side, and between the rim structures are channels extending between boundaries formed by the rim structures and the corresponding holes of the mesh structure, wherein the top sides of the rim structures form at least part of the second surface, and heights of the rim structures are greater in a middle of the mesh structure as compared to heights of the rim structures at an edge of the mesh structure, wherein the holes are circular or elliptical or at least partly circular or elliptical, wherein center points of three adjacent holes of the multitude of holes of the curved mesh structure form an equilateral triangle or a triangle, the sides of which differ from each other in length by 20% at most, and wherein the protective structure further comprises a ventilation hole arranged between three adjacent holes of the multitude of holes of the curved mesh structure, wherein the ventilation hole is configured to open to at least one channel of the channels arranged between the rim structures.

2. The protective structure according to claim 1, wherein the rim structures are separate from each other.

3. The protective structure according to claim 1, wherein the rim structures are continuous at holes that are not connected to the border frame.

4. The protective structure according to claim 1, wherein a thickness of the border frame is less than the distance between the first surface and the second surface at the edge of the mesh structure.

5. The protective structure according to claim 1, wherein at least one of the curvature radiuses of the second surface is greater than the corresponding curvature radiuses of the first surface.

6. The protective structure according to claim 1, wherein the border frame is configured such that at least a cushioning layer and a supporting layer of fabric are fixed to the border frame.

7. The protective structure according to claim 6, wherein, the cushioning layer and the supporting layers of fabric are fixed to the to the border frame such that middle parts of the cushioning layer and the supporting layers of fabric are separate from the second surface.

8. The protective structure according to claim 1, wherein at least some of the holes comprises a collar structure the inner side of the rim structure, and an upper side of the collar structure is on the same level as the first surface.

9. The protective structure according to claim 1, wherein at least some of the holes have comprise a collar structure at an inner side of the rim structure, and the upper side of the collar structure is on the same level as the second surface.

10. The protective structure according to claim 1, wherein the mesh structure and the border frame comprise a material or composite material configured for injection moulding.

11. The protective structure according to claim 1, wherein the mesh structure and the border frame are coated with a material containing metallic particles.

12. The protective structure according to claim 11, wherein the metallic particles comprises a metallic material having a microstructure that is fine-grained with an average grain size between 2 and 5,000 nm.

13. The protective structure according to claim 1, wherein an empty space formed by the holes in the mesh structure comprises at least 60% of the total area of the mesh structure.

14. The protective structure according to claim 1, wherein diameters of the holes situated wholly in the mesh structure are between 2 and 7 cm.

* * * * *